US008295723B2

(12) United States Patent
Kobashi et al.

(10) Patent No.: US 8,295,723 B2
(45) Date of Patent: Oct. 23, 2012

(54) IMAGE FORMING APPARATUS AND IMAGE FORMING METHOD WITH IMPROVED PROTECTIVE AGENT PROPERTIES

(75) Inventors: Masaru Kobashi, Matsumoto (JP); Yoichi Yamada, Shiojiri (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 653 days.

(21) Appl. No.: 12/489,248

(22) Filed: Jun. 22, 2009

(65) Prior Publication Data

US 2010/0021190 A1 Jan. 28, 2010

(30) Foreign Application Priority Data

Jul. 25, 2008 (JP) ..... 2008-191794

(51) Int. Cl.
*G03G 15/02* (2006.01)

(52) U.S. Cl. ..... 399/50; 399/168; 399/171; 399/175; 399/343; 399/346

(58) Field of Classification Search ..... 399/50, 399/171, 343, 346, 168, 175
See application file for complete search history.

(56) References Cited

U.S. PATENT DOCUMENTS

| | | | | |
|---|---|---|---|---|
| 7,251,437 | B2 * | 7/2007 | Tamoto et al. | 399/159 |
| 7,505,728 | B2 * | 3/2009 | Yamaguchi et al. | 399/346 |
| 7,593,682 | B2 * | 9/2009 | Tokumasu et al. | 399/346 |
| 7,680,446 | B2 * | 3/2010 | Shintani et al. | 399/346 |
| 7,693,475 | B2 * | 4/2010 | Shakuto et al. | 399/346 |
| 7,715,761 | B2 * | 5/2010 | Uda et al. | 399/168 |
| 7,826,787 | B2 * | 11/2010 | Hatakeyama et al. | 399/346 |
| 7,894,758 | B2 * | 2/2011 | Shintani et al. | 399/346 |
| 7,899,382 | B2 * | 3/2011 | Hozumi et al. | 399/346 |
| 7,929,875 | B2 * | 4/2011 | Nishida | 399/48 |
| 7,970,334 | B2 * | 6/2011 | Yamashita et al. | 399/346 |
| 7,986,910 | B2 * | 7/2011 | Kabata et al. | 399/346 |
| 8,107,872 | B2 * | 1/2012 | Ozaki et al. | 399/346 |
| 8,175,497 | B2 * | 5/2012 | Kobashi et al. | 399/168 |
| 2006/0133872 | A1 * | 6/2006 | Sugiura et al. | 399/346 |
| 2008/0118286 | A1 * | 5/2008 | Yamashita et al. | 399/346 |

FOREIGN PATENT DOCUMENTS

| | | | |
|---|---|---|---|
| JP | 09-081005 | | 3/1997 |
| JP | 2005134791 | A * | 5/2005 |
| JP | 2006-039380 | | 2/2006 |
| JP | 2006113499 | A * | 4/2006 |
| JP | 2006-235563 | | 9/2006 |
| JP | 2006350240 | A * | 12/2006 |
| JP | 2007-086262 | | 4/2007 |
| JP | 2007-093983 | | 4/2007 |
| JP | 2008020819 | A * | 1/2008 |
| JP | 2008122870 | A * | 5/2008 |
| JP | 2008224828 | A * | 9/2008 |
| JP | 2008233253 | A * | 10/2008 |

* cited by examiner

*Primary Examiner* — David Gray
*Assistant Examiner* — Francis Gray
(74) *Attorney, Agent, or Firm* — DLA Piper LLP (US)

(57) ABSTRACT

An image forming method and apparatus in which a protective agent is supplied to an image carrier, and the image carrier is charged by a plurality of charging units. Degrees of discharge deterioration of the surface of the image carrier in the plurality of charging units are different, and the amount of protective agent supplied to a charging portion of a charging unit, in which a degree of discharge deterioration of the surface of the image carrier is high, is large.

15 Claims, 4 Drawing Sheets

IMAGE FORMING APPARATUS AND IMAGE FORMING METHOD WITH IMPROVED PROTECTIVE AGENT PROPERTIES

BACKGROUND

Technical Field

The present invention relates to an image forming apparatus such as a copier, a facsimile machine or a printer, and an image forming method, and, more particularly, an image forming apparatus which includes an image carrier, a plurality of charging units for charging this image carrier, an exposure unit for forming an electrostatic latent image on the image carrier charged by the plurality of charging units by exposure, and a development unit for developing the electrostatic latent image formed by the exposure unit, and a transfer unit for transferring the image developed by the development unit, controls the amount of protective agent supplied to the plurality of charging units according to a deterioration degree of the image carrier in the plurality of charging units in applying of a protective agent to the plurality of charging units of the image carrier, and prevents mixing of the protective agent into the development unit and transferring of the protective agent to the transfer unit, and an image forming method.

Since the deterioration of resin configuring a photosensitive layer or generation of a discharge product being adhered to the surface of a photosensitive body can be suppressed by applying the protective agent on a photosensitive body such as stearic acid, the prolongation of the life of the photosensitive body can be realized. In addition, since abrasion of the front contact portion of a blade or driving torque of the photosensitive body can be reduced in a process having a cleaner blade, particularly, a configuration for applying the protective agent by a high-speed machine or a large-sized machine is generally used.

Most of higher fatty acids (stearic acid or the like) which is widely used as a protective agent has a low melting point, and if higher fatty acid is mixed to a development device, filming is caused. In particular, in the high-speed machine, since the rotation speed of a development roller is high, the heating temperature of the development roller is also increased by heating the gear portion or friction heat of a seal portion and thus filming is apt to be more easily generated.

In one-component development system, if a large amount of protective agent is mixed into the development device, the friction in a contact portion with a supply member or a contact portion with a regulation member is changed, and the supply property of the toner or the transportation property and the charging property of the toner is influenced even though filming is not caused, and the image quality deterioration, fog, scattering, or omission may be caused. In addition, in the contact development using a rubber roller, since a development roller or the toner transported onto the development roller is directly brought into contact with the protective agent applied on the photosensitive body, the protective agent applied on the photosensitive body is apt to be more easily mixed into the development device and thus the above-described problem further becomes serious.

Due to this reason, it is difficult to realize the prolongation of the life of the photosensitive body by the configuration for applying the protective agent on the photosensitive body in the one-component development system. Meanwhile, even in two-component development systems, since a magnetic napping is brought into contact with the photosensitive body, the mixing of the protective agent on the photosensitive body into the development device is not completely suppressed and a sufficient amount of protective agent cannot be applied on the photosensitive body in consideration of the filming of the carrier or the like. In addition, even when the protective agent is not mixed into the development device, if the protective agent applied on the image carrier is excessive, the development of the toner of the photosensitive body exposure unit is disturbed. Thus, the concentration of the toner in the printing unit is decreased or concentration nonuniformity occurs.

In addition, the excessive protective agent on the image carrier is attached to a transfer roller or the like such that a transfer property deteriorates or a transportation property of a transfer material deteriorates, causing a paper jam. In a color machine, the surface layer of the transfer belt or the surface layer of the transfer drum functioning as an intermediate transfer body may be contaminated or transfer nonuniformity occurs.

In an image forming apparatus for cleaning the residual toner left after transfer on a photosensitive body by a cleaning blade, the cleaning blade, a charging unit and a protective agent supplying unit are arranged on the photosensitive body in this order, in the portion in which the amount of residual toner left after transfer is large, the applied protective agent is removed together with the residual toner by the cleaning blade, the protective agent is not sufficiently supplied to the charging unit, partial attachment of a discharge product or deterioration of the photosensitive layer is generated, and nonuniform image occurs.

If the charging unit, the cleaning blade, and the protective agent supplying unit are arranged on the photosensitive body in this order, the residual toner on the photosensitive body is charged by the charging unit. Therefore, the attachment of the residual toner to the photosensitive body is increased, cleaning effect of the cleaning blade deteriorates, and cleaning failure is apt to occur. The occurrence of the toner cleaning failure causes filming of the toner on the photosensitive body and deteriorates the image quality.

If the charging unit, the protective agent supplying unit and the cleaning blade are arranged on the photosensitive body in this order, the residual toner left after transfer on the photosensitive body is attached to the protective agent supplying unit, the scraping ability of the protective agent is insufficient, and the amount of protective agent supplied onto the photosensitive body is decreased. By supplying the residual toner attached to the protective agent supplying unit to the surface of the protective agent, the amount of protective agent supplied onto the photosensitive body is decreased.

Originally, in a small-diameter toner having a diameter of less than 5 μm or a high-circularity toner of circularity of more than 0.96, there is a limitation in the cleaning property of the cleaning blade. If the contact pressure or the contact angle of the cleaning blade is increased, in particular, when the protective agent is applied, the front end of the cleaning blade is turned up by a variation in viscosity of the protective agent due to a variation in temperature of the machine or a variation in staying state of the protective agent at the front end of the blade or the torque of the blade contact portion is increased. In order to strictly manage the amount of protective agent applied or remove the deteriorated protective agent with certainty, the toner needs to be periodically consumed between sheets of paper, before or after an image forming operation is started or the like.

As known technologies of applying the protective agent on the protective body, JP-A-2007-86262 discloses an image forming apparatus for applying a protective agent by an applying member after charging, uniformizing the protective agent by a uniformizing member, and then performing a development process. In addition, JP-A-9-81005 discloses an image forming apparatus for charging a photosensitive body after a protective agent is applied. In addition, JP-A-2006-235563 and JP-A-2007-93983 disclose a configuration for applying a protective agent on the photosensitive body using a cleaning blade, applying a toner, which is originally unnecessary for forming an image, on the photosensitive body periodically or by an image occupancy ratio, and refreshing the residue on the photosensitive body. In addition, JP-A-2006-39380 discloses the removal of the protective agent applied on the photosensitive body by a contact member.

However, in JP-A-2007-86262, a unit for preventing the transfer of the protective agent on the development device or a transfer member is not considered and the development of filming or the contamination of the transfer member cannot be prevented. In addition, since the contact member is present after the image carrier is charged, the charging uniformity of the image carrier is lost by friction of the contact member or the like, crack or nonuniformity occurs, and high image quality cannot be realized. In addition, according to a charged column of the contact member, the protective agent may be charged by friction with the contact member to cause it to mix into the development device. In addition, if cleaning failure is generated due to an environment variation or the like, the protective agent supplying unit is contaminated by the residual toner and thus the function of the protective agent deteriorates.

In JP-A-9-81005, since the photosensitive body is charged after the protective agent is applied, the uniformity of the charging potential of the photosensitive body is ensured, but the protective agent is charged to the same polarity as the regular polarity of the toner by the charging unit, the protective agent deteriorated in the charging unit is transported to the development unit of the downstream side, the protective agent is mixed into the development device in the development unit, and filming of the development roller deteriorates. In this case, even when cleaning failure is generated, the cleaning failure toner is recovered by the development and thus the protective agent supplying unit is not contaminated by the residual toner.

Both JP-A-2006-235563 and JP-A-2007-93983 use a cleaner blade. In addition, the protective agent is applied on the photosensitive body, the toner which is originally unnecessary for forming the image is applied on the photosensitive body periodically or by the image occupancy ratio, and the residue on the photosensitive body is refreshed. However, the number of sheets which can be printed by a printing pattern used by a user is smaller than a predetermined number of sheets. In order to avoid this, an extra toner needs to be initially filled up or a container for recovering the consumed toner needs to be increased.

In JP-A-2006-39380, the contact member for removing the protective agent after the photosensitive body is charged and is arranged, but, if the removing member has a blade shape, the charging potential is nonuniform like stripe. If the removing member has a roller shape, the charging potential is changed in a roller period and a problem occurs in the image. In addition, it the cleaning unit is provided at the downstream side of the protective agent supplying unit, the supply of a lubricant to the charging unit is insufficient. Even in the configuration in which the protective agent supplying unit is arranged at the downstream side of the cleaning member, if the removing member is the roller member, the removal of the protective agent is not completely performed, the photosensitive body is transported to the transfer unit and the development unit while the leaked protective agent is charged to the same polarity as the toner by the charging device, the mixing of the protective agent into the development roller or the transferring of the protective agent to the transfer material of the transfer unit occurs. Even when the protective agent is removed using the blade, since the protective agent is charged by the charging unit, the attachment with the photosensitive body becomes strong and thus the protective agent cannot be completely removed. When the contact pressure of the blade becomes strong, the protective agent is adhered onto the photosensitive body as a fixed layer and thus the deteriorated protective agent is hard to be removed.

SUMMARY

An advantage of some aspects of the invention is that it provides an image forming apparatus for supplying a required amount of protective agent to a plurality of charging units and an image forming method, which are capable of preventing mixing of a protective agent into a development unit and transferring of the protective agent to a transfer member of a transfer unit by a configuration for applying the protective agent on a photosensitive body, recovering the deteriorated protective agent by a cleaning unit, preventing the deteriorated protective agent from staying on the photosensitive body.

According to an aspect of the invention, there is provided an image forming method including: supplying a protective agent to an image carrier; and charging the image carrier by a plurality of charging units. Degrees of discharge deterioration of the surface of the image carrier in the plurality of charging units are different. In the amounts of protective agent supplied to charging portions of the plurality of charging units, the amount of protective agent supplied to a charging portion, in which a degree of discharge deterioration of the surface of the image carrier is high, is large. Accordingly, a sufficient amount of protective agent is supplied to the charging portion having the high degree of discharge deterioration and only a necessary amount of protective agent is supplied to the charging portion having the low degree of discharge deterioration such that the applying of excessive protective agent is suppressed.

In the image forming method according to the invention, in the charging of the image carrier by the plurality of charging units, changes in charging potential of the image carrier in the charging portions are different, and the amount of protective agent supplied to the charging portion in which the change in charging potential of the image carrier is larger than the amount of protective agent supplied to the charging portion in which the change in charging potential of the image carrier is small. Accordingly, since the amount of discharge deterioration is proportional to the change in potential, it is possible to prevent excessive protective agent from being supplied by the applying of the protective agent as occasion demands.

In the image forming method according to the invention, the charging of the image carrier by the plurality of charging units includes: a charging process of increasing an absolute value of the charging potential of the image carrier, and a charging process of decreasing the absolute value of the charging potential of the image carrier, the amount of protective agent supplied to the charging process of increasing the absolute value of the charging potential of the image carrier is larger than the amount of protective agent supplied to the charging process of decreasing the absolute value of the charging potential of the image carrier. Accordingly, in the charging of decreasing the absolute value of the charging potential of the image carrier, that is, in the neutralizing direction, since the degree of discharge deterioration of the image carrier is low, it is possible to reduce the supply amount of the protective agent, prevent excessive protective agent from being supplied, and reduce the mixing and the transferring of the protective agent to another process.

In the image forming method according to the invention, in the charging of the image carrier by the plurality of charging units, a change in charging potential to the image carrier in the charging portion of a first charging process is larger than a change in charging potential to the image carrier in the charging portion of a subsequent charging process, the charging portion of a final charging process decreases the absolute value of the charging potential of the image carrier, the supplying of the protective agent is provided before the first charging process, and controlling of the amount of protective agent supplied to the image carrier is provided between the charging process by the plurality of charging units. Accordingly, a smaller amount of the protective agent is supplied to the charging portion located at the downstream side and having the low degree of discharge deterioration, compared with the charging portion located at the upstream side and with a high degree of discharge deterioration.

In the image forming method according to the invention, the plurality of charging units includes a main charging unit and an auxiliary charging unit, the main charging unit is located at an upstream side of the auxiliary charging unit in a movement direction of a photosensitive body, the degree of discharge deterioration of the surface of the image carrier in the charging process by the main charging unit is higher than the degree of discharge deterioration of the surface of the image carrier in the charging process by the auxiliary charging unit, and the amount of protective agent supplied to the charging portion of the main charging unit is larger than the amount of protective agent supplied to the charging portion of the auxiliary charging unit. Accordingly, it is possible to supply a sufficient amount of the protective agent to the main charging unit, suppress the application of excessive amounts of the protective agent to the auxiliary charging unit, and prevent the mixing of the protective agent into the development unit or the transferring of the protective agent to the transfer unit.

In the image forming method according to the invention, the supplying of the protective agent to the image carrier is provided before the charging process by the main charging unit, and controlling of the amount of protective agent supplied to the auxiliary charging unit is provided between the charging process by the main charging unit and the charging process by the auxiliary charging unit. Accordingly, it is possible to control the amount of the protective agent supplied to the auxiliary charging unit and supply an optimal amount of protective agent to the auxiliary charging unit.

In the image forming method according to the invention, the controlling of the amount of protective agent includes recovering a portion of the protective agent deteriorated in the main charging unit by the force of an electric field. Accordingly, since the protective agent is charged while protecting the photosensitive layer in the main charging unit, most of the protective agent is recovered in the controlling of the protective agent supply amount. Since the controlling the amount of protective agent supply recovers the protective agent by the electric field, the protective agent is weak against charging or the protective agent inversely charged in the main charging unit can pass through the controlling of the protective agent supply amount, the protective agent reaches the auxiliary charging unit, and the discharge deterioration of the photosensitive body in the auxiliary charging unit is suppressed.

In the image forming method according to the invention, the charging process by the main charging unit charges the surface of the image carrier and the residue on the image carrier to the same polarity as a regular charging polarity of a toner, the controlling of the amount of protective agent includes a cleaning process of recovering the residue on the image carrier after transfer by force of an electric field, and the charging process by the auxiliary charging unit is a charging process of emitting charges having the polarity opposite to a regular charging polarity of a toner on the image carrier such that the charging potential of the image carrier is smaller than the charging potential charged by the main charging unit in an absolute value thereof. Accordingly, since the protective agent subjected to the cleaning process is charged to the polarity that is opposite to the regular polarity of the toner by the auxiliary charging unit, the mixing of the protective agent into the development roller in the development unit and the transferring of the protective agent to the transfer member in the transfer unit can be suppressed with certainty.

In the image forming method according to the invention, the same member is used for the protective agent supplying unit that is used in the supplying of the protective agent and the main charging unit. Accordingly, since the processes of main charging and the supplying of the protective agent are simultaneously performed, space can be saved. In addition, since the contacting process of the image carrier is reduced, it is advantageous with respect to the abrasion of the image carrier. By the discharge between the main charging unit and the image carrier, the protective agent can be applied while being charged to the same polarity as the regular polarity of the toner. In addition, since the surface of the image carrier can be charged in a state in which the protective agent is attached to the surface of the main charging unit, abnormal local discharge at a minute gap between the main charging unit and the surface of the image carrier can be suppressed and thus the charging potential does not become nonuniform. Accordingly, since the uniformization of the charging potential of the auxiliary charging unit is facilitated and the change in charging potential of the auxiliary charging unit can be decreased, it is possible to further suppress discharge deterioration. In addition, it is possible to suppress the generation of ozone to the minimum.

In the image forming method of according to the invention, the same member is used for a protective agent supplying unit used in the supplying of the protective agent and a main charging unit. In addition, the member used for the protective agent supplying unit and the main charging unit is a conductive brush roller. Accordingly, since the pressing force of the brush roller applied to the image carrier is weak compared with a solid roller, risk of the filming of the brush roller and the image carrier is low.

In the image forming method of according to the invention, the auxiliary charging unit is a scorotron charger, applies a voltage having the same polarity as a regular charging polarity of a toner to a grid, and flows current having the polarity opposite to the regular charging polarity of the toner to a wire. Accordingly, since the non-contact charging is performed, the protective agent is not adhered to the charger and deterioration of charging performance of the auxiliary charging unit can be prevented, and long life span is achieved. The bias having the same polarity as the regular charging polarity of the toner is applied to the grid and the bias having the polarity opposite to the regular charging polarity of the toner is applied to the wire. Accordingly, corona having the polarity opposite to the regular charging polarity of the toner is spread while the charging potential of the image carrier is maintained to the same polarity as the regular charging polarity of the toner and thus the protective agent can be charged to the polarity opposite to the regular charging polarity of the toner. In addition, since the charging potential of the image carrier attains an equilibrium state at a grid voltage, it is possible to uniformize the charging potential of the image carrier which becomes nonuniform due to the applying of the protective agent or the rubbing of the protective agent supplying unit. The second charging unit can perform neutralizing by a potential for eliminating the nonuniformity of the charging generated due to the first charging unit and minimize the generation of ozone or the generation of the discharge product in the auxiliary charging unit, and the deterioration of the photosensitive layer.

In the image forming method of according to the invention, uniformizing of the protective agent on the image carrier is provided between the supplying of the protective agent and the charging process by the auxiliary charging unit. Accordingly, since the cleaning property of the toner is not required, the degree of freedom for setting a contact angle, a contact direction and a contact load is high, it is possible to prevent the protective agent from becoming a fixed layer or the deteriorated protective agent from being adhered on the photosensitive body. In addition, it is possible to uniformize the protective agent and reduce local deterioration of the surface layer of the photosensitive body.

In the image forming method of according to the invention, the method further includes: forming an electrostatic latent image on the image carrier; developing the latent image on the image carrier. The developing is non-contact developing. Accordingly, it is possible to prevent the mixing of the physical protective agent due to the contact of the development member. In addition, even when the charging of the protective agent is weak, it is easy to prevent or suppress the mixing into the development unit.

According to an another aspect of the invention, there is provided an image forming apparatus including: a rotatable image carrier; a protective agent supplying unit supplying a protective agent on the image carrier; a plurality of charging units charging the image carrier; an exposure unit forming an electrostatic latent image on the image carrier; a development unit developing the electrostatic latent image of the image carrier; and a transfer unit transferring the image of the image carrier. Degrees of discharge deterioration of the surface of the image carrier in the plurality of charging units are different. A protective agent supply amount control unit for controlling the amount of the protective agent supplied to a charging portion of a charging unit having a low degree of discharge deterioration to be smaller than the amount of the protective agent supplied to a charging portion having a high degree of discharge deterioration. Accordingly, a sufficient amount of protective agent is supplied to the charging portion having the high degree of discharge deterioration and only a necessary amount of protective agent is supplied to the charging portion having the low degree of discharge deterioration such that the applying of excessive protective agent is suppressed.

According to a another aspect of the invention, there is provided an image forming apparatus including: a rotatable image carrier; a protective agent supplying unit supplying a protective agent on the image carrier; a main charging unit charging the image carrier; an auxiliary charging unit located at the downstream side of the main charging unit in a movement direction of the image carrier and charging the image carrier; an exposure unit forming an electrostatic latent image on the image carrier; a development unit developing the electrostatic latent image of the image carrier; and a transfer unit transferring the image of the image carrier, the main charging unit charges the surface of the image carrier and the residue on the image carrier to the same polarity as the regular polarity of a toner. A change in charging potential of the image carrier in the main charging unit is larger than a change in charging potential of the image carrier in the auxiliary charging unit, and the main charging unit charges the image carrier such that the charging potential of the image carrier is large in an absolute value thereof. The auxiliary charging unit charges the image carrier such that the charging potential of the image carrier is small in the absolute value thereof. The main charging unit is a conductive brush roller functioning as the protective agent supplying unit. A protective agent supply amount control unit is provided between the main charging unit and the auxiliary charging unit. A uniformizing member which uniformizes the protective agent is included between the protective agent supply amount control unit and the auxiliary charging unit. The protective agent supply amount control unit is a conductive brush roller functioning as a cleaning unit which removes the residue on the image carrier by an electric field. The auxiliary charging unit is a scorotron charger, applies a voltage having the same polarity as a regular charging polarity of a toner to a grid, and flows current having the polarity opposite to the regular charging polarity of the toner to a wire. Accordingly, a sufficient amount of protective agent is supplied to the charging portion having a high degree of discharge deterioration and only a necessary amount of protective agent is supplied to the charging portion having the low degree of discharge deterioration such that the applying of excessive protective agent is suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
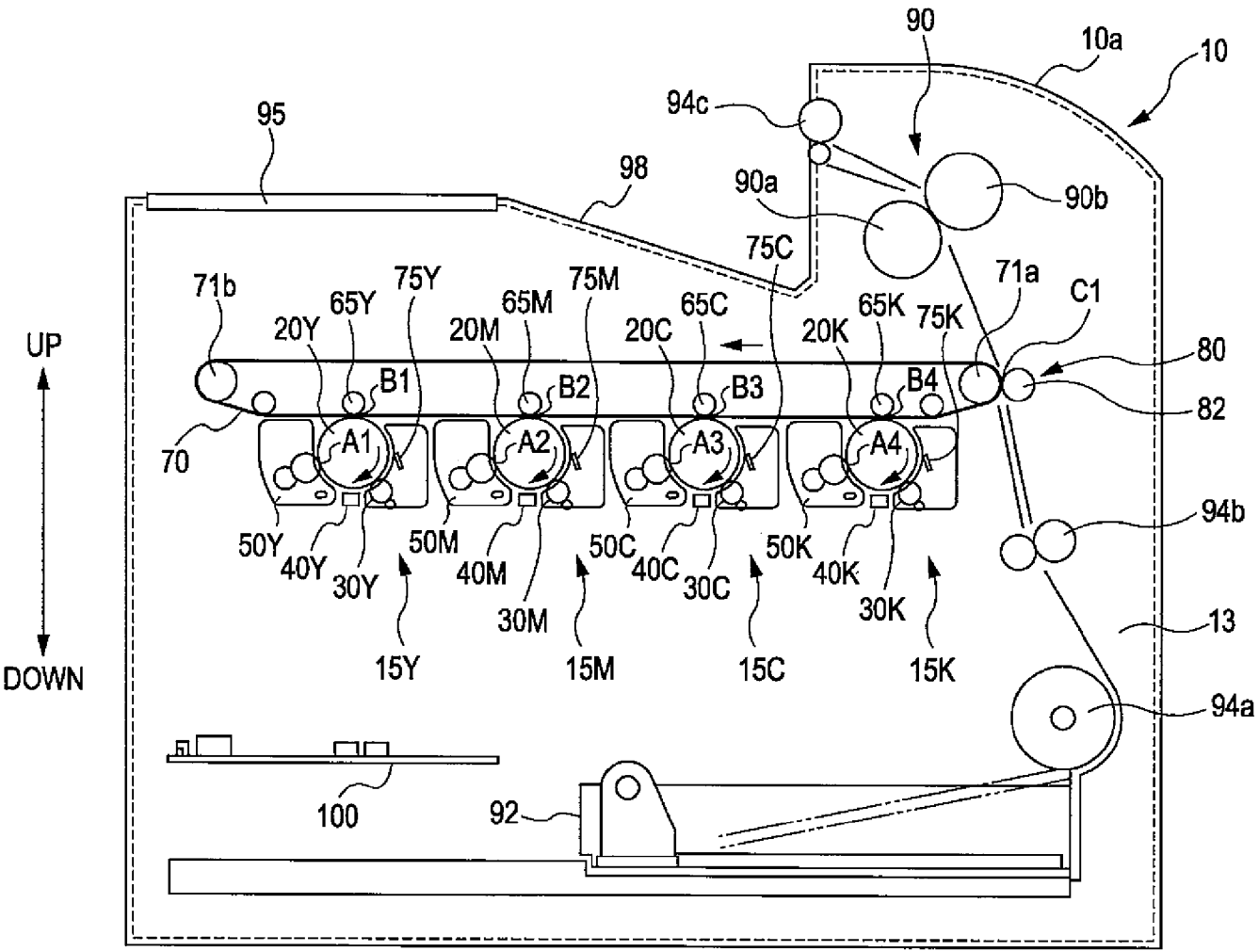
FIG. 1 is a view showing the whole of an image forming apparatus according to the invention.

Hereinafter, embodiments of the invention will be described with reference to the accompanying drawings. FIG. 1 is a view showing the whole of an image forming apparatus according to the invention.

As shown in FIG. 1, the image forming apparatus 10 includes four image forming stations 15 (Y, M, C and K), an intermediate transfer belt 70, a secondary transfer unit 80, a fixing unit 90, a display unit 95 including a reporting unit to a user and including a liquid crystal panel, and a control unit 100 for controlling these units and performing the operation of the image forming apparatus.

The image forming stations 15 (Y, M, C and K) have functions for forming an image by toners of yellow (Y), magenta (M), cyan (C) and black (K). The configurations of the image forming stations 15 (Y, M, C and K) are equal and, hereinafter, the image forming station 15Y will be described.

As shown in FIG. 1, the image forming station 15Y has a charging unit 30Y, an exposure unit 40Y, a development unit 50Y, a primary transfer portion B1 and a photosensitive body cleaning unit 75Y in a rotation direction of a photosensitive body 20Y which is an example of an image carrier.

The photosensitive body 20Y has a cylindrical base material and a photosensitive layer formed on the circumferential surface thereof, can rotate around a central axis, and, in the present embodiment, rotates in a clockwise direction as denoted by the arrow.

The charging unit 30Y is a device for charging the photosensitive body 20Y. An electrostatic latent image is formed on the charged photosensitive body 20Y by irradiating laser from the exposure unit 40Y.

The exposure unit 40Y has a semiconductor laser, a polygon mirror, an F-θ lens and the like, and irradiates modulated laser onto the charged photosensitive body 20Y based on an image signal input from a host computer (not shown) such as a personal computer or a word processor.

The development unit 50Y is a device for developing the latent image formed on the photosensitive body 20Y using the toner of yellow (Y). In the development unit 50Y, a development roller and a toner supply roller are arranged in a development chamber to which a new toner is supplied from a replaceable toner cartridge, and a regulation blade is brought into contact with the development roller such that the toner on the development roller thins.

The primary transfer portion B1 transfers a yellow toner image formed on the photosensitive body 20Y onto the intermediate transfer belt 70. In the primary transfer unit B1, a primary transfer roller 65Y for applying a primary transfer bias is disposed. When four toners are sequentially transferred to be superposed by the primary transfer units B1, B2, B3 and B4, a full-color toner image is formed on the intermediate transfer belt 70.

The intermediate transfer belt 70 is an endless belt stretched over a belt driving roller 71*a* and a driven roller 71*b* and is rotated and driven in a state of being in contact with the photosensitive bodies 20 (Y, M, C and K).

The secondary transfer unit 80 is a device for transferring a single-color toner image or a full-color toner image formed on the intermediate transfer belt 70 on a transfer material such as paper, a film, cloths or the like.

The fixing unit 90 is a device which includes a fixing roller 90*a* and a pressurization roller 90*b* and fuses the single-color toner image or the full-color toner image transferred on the transfer material to a permanent image.

The photosensitive body cleaning unit 75Y is a device which includes a photosensitive body cleaning blade 76Y made of rubber and being in contact with the surface of the photosensitive body 20Y and scraps and removes the toner left on the photosensitive body 20Y by the photosensitive body cleaning blade 76Y after the toner image is transferred onto the primary transfer portion BY and the intermediate transfer belt 70.

Next, the operation of the image forming apparatus 10 having the above-described configuration will be described.

First, an image signal and a control signal from a host computer (not shown) is input to a main controller of the image forming apparatus via an interface, the photosensitive body 20Y, the development roller provided in the development unit 50Y, the intermediate transfer belt 70 and the like are rotated under the control of a unit controller based on the command from the main controller. The photosensitive body 20Y is sequentially charged by the charging unit 30Y at a charging position while rotating.

The charged region of the photosensitive body 20Y reaches an exposure position by the rotation of the photosensitive body 20Y such that the latent image according to the image information of yellow (Y) is formed in the region by the exposure unit 40Y.

The latent image formed on the photosensitive body 20Y reaches to a development position by the rotation of the photosensitive body 20Y so as to be developed by the development unit 50Y. Accordingly, the toner image is formed on the photosensitive body 20Y.

The toner image formed on the photosensitive body 20Y reaches the position of the primary transfer portion B1 by the rotation of the photosensitive body 20Y so as to be transferred onto the intermediate transfer belt 70 by the primary transfer unit. At this time, a primary transfer voltage having a polarity opposite to a charging polarity of the toner is applied from the primary transfer roller 65Y in the primary transfer unit. As a result, the four toner images formed on the photosensitive bodies 20 (Y, M, C and K) are transferred so as to be superposed on the intermediate transfer belt 70, and the full-color toner image is formed on the intermediate transfer belt 70.

The intermediate transfer belt 70 is driven by sending driving force from a belt driving unit such as a motor via the belt driving roller 71*a*.

The full-color toner image formed on the intermediate transfer belt 70 is transferred onto the transfer material such as paper by the secondary transfer unit 80. Such a transfer material is transported from a feed tray to the secondary transfer unit 80 using a feed roller 94*a* and a registration roller 94*b*.

The full-color toner image transferred onto the transfer material is heated and pressurized by the fixing unit 90 so as to be fused on the transfer material. The transfer material is ejected by an ejection roller 94*c* after passing through the fixing unit 90.

Meanwhile, the photosensitive bodies 20 (Y, M, C and K) are neutralized by a neutralizing unit (not shown) after passing the positions of the primary transfer portions B1, B2, B3 and B4, and the toners attached to the surfaces thereof are scraped by the photosensitive body cleaning blades supported on the photosensitive body cleaning units 75 (Y, M, C and K) so as to prepare for a next charging process for forming the latent image. The scraped toners are recovered into residual toner recovery portions included in the photosensitive body cleaning units 75 (Y, M, C and K).

An intermediate transfer belt cleaning device (not shown) is provided on the side of the driven roller 71*b* of the intermediate transfer belt 70 after the secondary transfer, and the intermediate transfer belt 70 after the secondary transfer is cleaned.

In addition, although the embodiment of the intermediate transfer method using the intermediate transfer belt is described, a direct transfer type image forming apparatus may be used.

In such an image forming apparatus, by applying a protective agent such as stearic acid on the photosensitive body, the deterioration of resin configuring the photosensitive layer or generation of discharge product attached to the surface of the photosensitive body can be suppressed. Thus, prolongation of the life of the photosensitive body can be realized.

Figure 2:
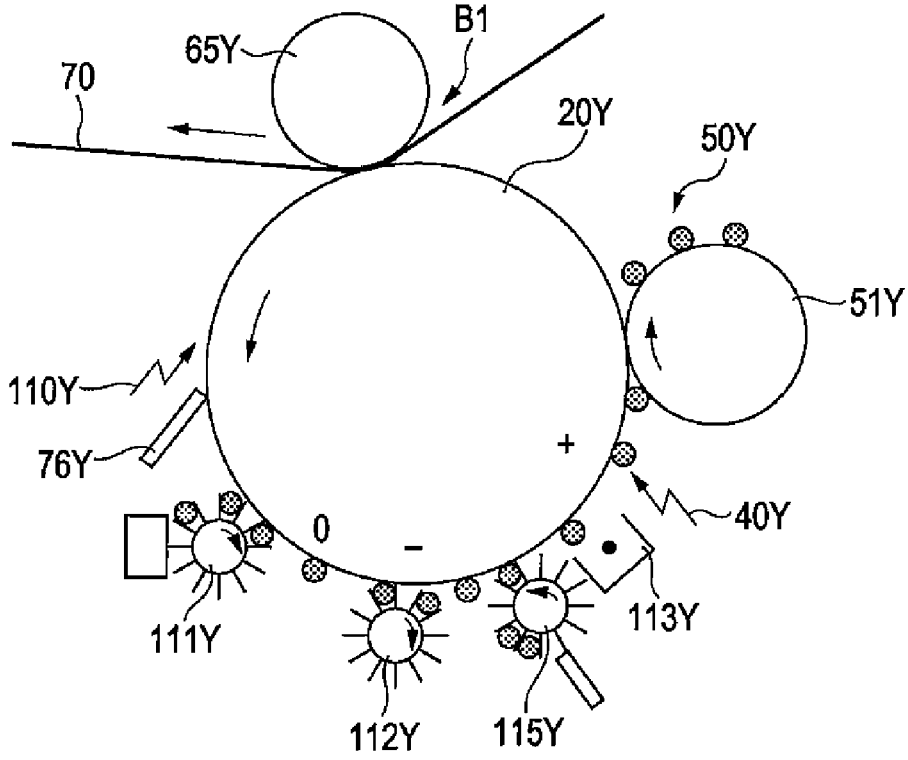
FIG. 2 is a view showing the embodiment of the invention.

FIG. 2 shows an image forming apparatus according to Embodiment 1 for solving the problems of the known apparatus in the image forming apparatus 10 for applying the protective agent on the photosensitive bodies 20 (Y, M, C and K). Although the image forming apparatus of Embodiment 1 may be applied to a single-color image forming apparatus, FIG. 2 shows, for example, the yellow image forming unit 15Y of a color image forming apparatus.

The photosensitive body 20Y has the cylindrical conductive base material and the photosensitive layer formed on the circumferential surface thereof, can rotate around the central axis, and, in Embodiment 1 shown in FIG. 2, rotates in a counter-clockwise direction as denoted by an arrow.

In the photosensitive body 20Y, a neutralizing unit 110Y is disposed at the downstream side of the primary transfer portion B1 such that the photosensitive body 20Y after primary transfer is neutralized. The photosensitive body cleaning blade 76Y is disposed at the downstream side of the neutralizing unit 110Y. The photosensitive body cleaning blade 76Y uses a rubber blade having a hardness of 70°.

A protective agent supplying unit 111Y is disposed at the downstream side of the photosensitive body cleaning blade 76Y. The protective agent can protect the photosensitive layer of the photosensitive body 20Y and have lubricant effect. Metal salt of fatty acid may be used as the protective agent, and the protective agent may be formed in a powder shape or a solid shape according to the method of supplying the protective agent to the photosensitive body 20Y. In order to solve the problem such as scattering, the protective agent having the solid shape is preferably used. The metal elements configuring metal salt of fatty acid may include, for example, zinc, lithium, sodium, magnesium, aluminum, lead, nickel and the like and fatty acid configuring metal salt of fatty acid may include, for example, stearic acid, lauric acid, palmitic acid and the like. Among them, if the protective agent having the solid shape is used, zinc stearate is preferably used. In Embodiment 1, a conductive brush roller contacting with a zinc stearate block and having the protective agent applied thereon is used as the protective agent supplying unit 111Y. The conductive brush roller rotates in the clockwise direction opposite to the rotation direction of the photosensitive body 20Y.

A main charging unit 112Y of Embodiment 1 applies a bias of −1000 V and charges the surface of the photosensitive body 20Y and the protective agent applied on the photosensitive body 20Y by the protective agent supplying unit 111Y to the same polarity as the regular charging polarity of the toner. Since the discharge limit of the used photosensitive body is 600 V, the charging potential of the photosensitive body 20Y after the bias of the main charging unit 112Y is applied is −400 V. A protective agent supplying amount control unit 115Y is disposed at the downstream side of the main charging unit 112Y. The protective agent supplying amount control unit 115Y recovers a portion of the protective agent charged to the same polarity as the regular charging polarity of the toner in the protective agent passing through the main charging unit 112Y by the force of an electric field. The protective agent supplying amount control unit 115Y of Embodiment 1 is the conductive brush roller, rotates in the counter-clockwise direction which is equal to that of the photosensitive body 20Y, applies a DC bias of −200 V, and recovers a portion of the protective agent by a potential difference of 200 V with the surface of the photosensitive body charged by the main charging unit. The protective agent which is not charged by the main charging unit 112Y can pass through the protective agent supply amount control unit to reach an auxiliary charging unit 113Y. In addition, by controlling the bias applied to the protective agent supply amount control unit 115Y, the protective agent removal amount of the protective agent supply amount control unit 115Y can be controlled and the amount of protective agent supplied to the auxiliary charging unit 113Y can be controlled.

A scorotron charger which is the auxiliary charging unit 113Y applies a bias of −500 V, which has the same polarity as the regular charging polarity of the toner, to a grid, flows current of −100 μA, which has the same polarity as the regular charging polarity of the toner, to a wire, and spreads corona having the same polarity as the regular charging polarity of the toner on the surface of the photosensitive body. The potential of the photosensitive body 20Y after passing through the auxiliary charging unit 113Y becomes −500 V and the charging nonuniformity generated by the main charging unit becomes uniform. In addition, the protective agent on the photosensitive body after passing through the auxiliary charging unit is charged to the same polarity as the regular charging polarity of the toner.

The charging potential of the photosensitive body 20Y is changed from 0 V to −400 V by applying the bias by the main charging unit 112Y, and the change in charging potential is 400 V. Meanwhile, the charging potential of the photosensitive body 20Y is changed from −400 V to −500 V by applying the bias by the auxiliary charging unit 113Y, and a charging variation is 100 V. As a result, the degree of discharge deterioration of the charging portion of the photosensitive body 20Y by the main charging unit 112Y is higher than that of the charging portion of the photosensitive body 20Y by the auxiliary charging unit 113Y.

Therefore, in the image forming apparatus of Embodiment 1, the protective agent supplying unit 111Y is disposed at the downstream side of the main charging unit 112Y and a sufficient amount of protective agent is supplied to the charging portion of the main charging unit 112Y with a high degree of discharge deterioration. Meanwhile, since the charging portion of the auxiliary charging unit 113Y has a low degree of discharge deterioration, the protective agent supply amount control unit 115Y for recovering the portion of the protective agent by the electric field between the main charging unit 112Y and the auxiliary charging unit 113Y is disposed and the surplus protective agent is prevented from going to the charging portion of the auxiliary charging unit 113Y.

In the image forming apparatus of Embodiment 1, since the charging polarity by the auxiliary charging unit 113Y is the same as the regular charging polarity of the toner, the protective agent also has the same charging polarity as the regular charging polarity of the toner such that mixing into the development unit and transfer to the transfer unit are generated. However, since most of the protective agent is recovered by controlling the bias applied to the protective agent supply amount control unit 115Y disposed at the upstream side of the auxiliary charging unit 113Y, the amount of deteriorated protective agent transferred to the development unit and the transfer unit is restricted such that the deterioration of the photosensitive body 20Y can be prevented while suppressing development filming or the contamination of the transfer member to some extent. In the present embodiment, since the charging ability by the auxiliary charging unit 113Y is low, the degree of discharge deterioration of the photosensitive body 20Y is low and thus the deterioration of the photosensitive body 20Y can be prevented by a small amount of protective agent.

The operation of the image forming process of Embodiment 1 is shown in Table 1.

TABLE 1

| Process | Applied bias | Potential of photosensitive body | Polarity of protective agent | Amount of protective agent |
|---|---|---|---|---|
| Photosensitive body cleaning unit | | 0 V | Absence of protective agent | Absence of protective agent |
| Protective agent supplying unit | | | 0 | Large |

TABLE 1-continued

| Process | Applied bias | Potential of photosensitive body | Polarity of protective agent | Amount of protective agent |
|---|---|---|---|---|
| Main charging unit | Vbr1: −1000 V | −400 V | – | |
| Protective agent supply amount control unit | vbr2: −200 V | | | Small |
| Auxiliary charging unit | Vg: −500 V<br>Iw: −100 μA | −500 V | | |
| Exposure | | −100 V (exposure unit)/−500 V (non-exposure unit) | | |
| Development | Vdc: −150 V<br>Vpp: 1300 V | | Absence of protective agent | Absence of protective agent |
| Primary transfer | Vt1: +400 V | | | |
| Neutralizing | | 0 V | | |

Figure 3:
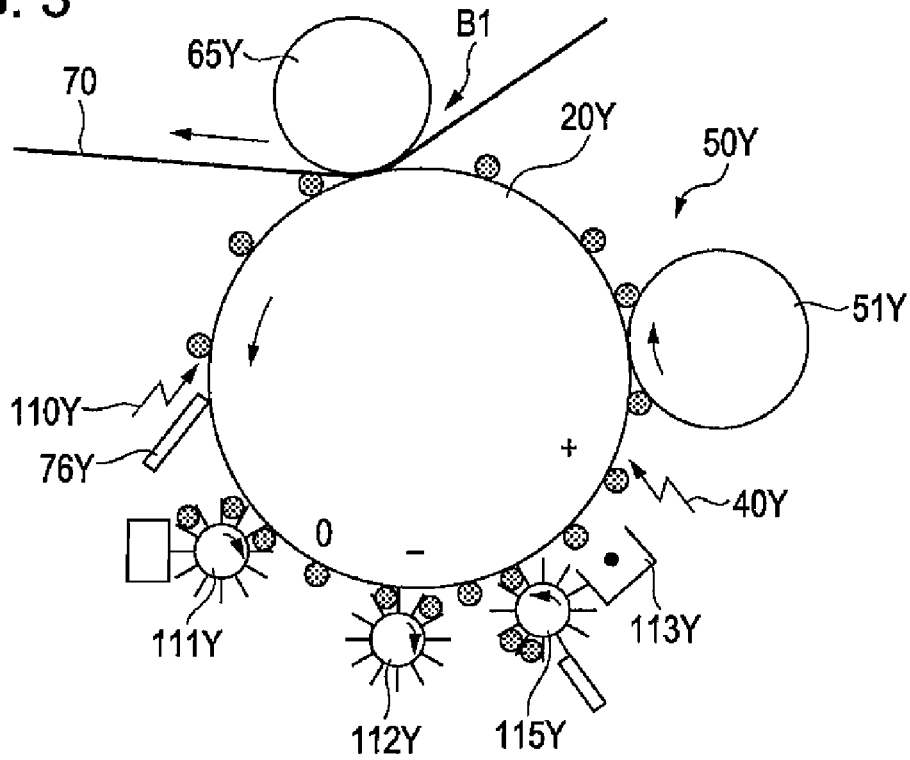
FIG. 3 is a view showing the embodiment of the invention.

FIG. 3 shows an image forming apparatus according to Embodiment 2 for solving the problems of the known apparatus, in the image forming apparatus for applying the protective agent on the photosensitive body. Although the image forming apparatus of Embodiment 2 may be applied to a single-color image forming apparatus, FIG. 3 shows, for example, a yellow image forming unit 15Y of a color image forming apparatus.

Similar to the image forming apparatus of Embodiment 1, in the image forming apparatus of Embodiment 2, the neutralizing unit 110Y, the photosensitive body cleaning blade 76Y, the protective agent supplying unit 111Y, the main charging unit 112Y, the protective agent supply amount control unit 115Y, the auxiliary charging unit 113Y, the exposure unit 40Y, the development unit 50Y, and the primary transfer unit are disposed at the downstream side of the primary transfer unit B1 in this order. The configuration of the image forming apparatus of Embodiment 2 is equal to that of the image forming apparatus of Embodiment 1 and thus the description thereof will be omitted.

The main charging unit 112Y is disposed at the downstream side of the protective agent supplying unit 111Y. The main charging unit 112Y charges the photosensitive body 20Y to the same polarity as the regular charging polarity of the toner by corona discharge. The corona discharge to the photosensitive body 20Y by the main charging unit 111Y charges the protective agent supplied onto the photosensitive body 20Y by the protective agent supplying unit 111Y to the same polarity as the regular charging polarity of the toner. The main charging unit 112Y of Embodiment 2 is a conductive brush roller. The conductive brush roller which is the main charging unit 112Y rotates in the clockwise direction which is opposite to the rotation direction of the photosensitive body 20Y, applies a DC bias of −1500 V exceeding 600 V which is a discharge limit of the photosensitive body used in the present embodiment to the photosensitive body, and charges the potential of the photosensitive body 20Y to −900 V.

The protective agent supply amount control unit 115Y is disposed at the downstream side of the main charging unit 112Y. The protective agent supply amount control unit 115Y recovers a portion of the protective agent charged to the same polarity as the regular charging polarity of the toner by the force of the electric field after the discharge by the main charging unit 112Y. The protective agent supply amount control unit 115Y of Embodiment 2 is a conductive brush roller, rotates in the counter-clockwise direction which is equal to that of the photosensitive body 20Y, applies a DC bias of −850 V, and recovers a portion of the protective agent charged to the same polarity as the regular charging polarity of the toner by a potential difference of 50 V with the charging potential of the photosensitive body charged by the main charging unit. Flicker made of a conductive metal plate is brought into contact with the conductive brush roller and the recovered protective agent is removed.

The auxiliary charging unit 113Y is disposed at the downstream side of the protective agent supply amount control unit 115Y. The auxiliary charging unit 113Y charges the protective agent, which is supplied to the photosensitive body 20Y by the protective agent supplying unit 111Y and passes through the protective agent supply amount control unit 115Y without being recovered, to the polarity opposite to the regular charging polarity of the toner. The auxiliary charging unit 113Y of Embodiment 2 uses a non-contact type scorotron charger. The scorotron charger applies a bias of −400 V, which has the same polarity as the regular charging polarity of the toner, to a grid, flows current of +200 μA, which has the polarity that is opposite to the regular charging polarity of the toner, to a wire, spreads corona having the polarity opposite to the regular charging polarity of the toner while maintaining the charging potential of the photosensitive body at the same polarity as the regular charging polarity of the toner, and charges the protective agent to the polarity opposite to the regular charging polarity of the toner. The potential of the photosensitive body 20Y after passing through the auxiliary charging unit 113Y becomes −400 V.

The exposure unit 40Y is disposed at the downstream side of the auxiliary charging unit 113Y. The exposure unit 40Y has a semiconductor laser, a polygon mirror, an F-θ lens and the like, and irradiates modulated laser onto the charged photosensitive body 20Y based on an image signal input from a host computer (not shown) such as a personal computer or a word processor.

The development unit 50Y is disposed at the downstream side of the exposure unit 40Y. The photosensitive body 20Y in which the latent image according to the image information of yellow Y is formed in the region by the exposure unit 40Y is developed by the development unit 50Y. In the development unit 50Y of Embodiment 2, a development roller 51Y is disposed at a predetermined development gap with the photosensitive body 20Y, in a non-contact type. A thin layer of toner charged by a toner supply roller or a regulation blade is formed on the development roller 51Y. A development bias obtained by superposing AC on DC is applied to the development roller 51Y, the toner flies on the surface of the photosensitive body 20Y, and the latent image of the photosensitive body 20Y is developed.

The primary transfer unit is disposed at the downstream side of the development unit 50Y. In the primary transfer unit, the primary transfer voltage having the polarity opposite to the charging polarity of the toner is applied from the primary transfer roller 65Y which is in contact with the photosensitive body 20Y at the primary transfer portion B1 through the intermediate transfer belt 70 such that the image of the photosensitive body 20Y is transferred onto the intermediate transfer belt 70.

The operation of the image forming process of Embodiment 2 is shown in Table 2.

TABLE 2

| Process | Applied bias | Potential of photosensitive body | Polarity of protective agent | Amount of protective agent |
|---|---|---|---|---|
| Photosensitive body cleaning unit | | 0 V | Absence of protective agent | Absence of protective agent |
| Protective agent supplying unit | | | 0 | large |
| Main charging unit | Vbr1: −1500 V | −900 V | − | |
| Protective agent supply amount control unit | Vbr2: −850 V | | | small |
| Auxiliary charging unit | Vg: −400 V<br>Iw: +200 μA | −400 V | + | |
| Exposure | | −100 V (exposure unit)/−400 V (non-exposure unit) | | |
| Development | Vdc: −150 V<br>Vpp: 1300 V | | | |
| Primary transfer | Vt1: +400 V | | | |
| Neutralizing | | 0 V | | |

In the image forming apparatus of Embodiment 2, the protective agent supplying unit 111Y, the main charging unit 112Y, the protective agent supply amount control unit 115Y and the auxiliary charging unit 113Y are disposed on the photosensitive body 20Y in this order. The main charging unit 112Y applies a bias of −1500 V exceeding 600 V which is a discharge limit of the photosensitive body used in the present embodiment, and charges the surface of the photosensitive body 20Y and the protective agent applied on the photosensitive body 20Y by the protective agent supplying unit 111Y to the same polarity as the regular charging polarity of the toner. The auxiliary charging unit 113Y emits charges having the polarity opposite to the regular charging polarity of the toner to the photosensitive body 20Y and the protective agent on the photosensitive body 20Y, in order to adjust the charging potential of the photosensitive body 20Y to be smaller than the potential charged by the main charging unit 112Y in an absolute value.

The charging potential of the photosensitive body 20Y is changed from 0 V to −900 V by applying the bias by the main charging unit 112Y, and a change in charging potential is 900 V. Meanwhile, the charging potential of the photosensitive body 20Y is changed from −900 V to −400 V by applying the bias by the auxiliary charging unit 113Y, and a charging variation is 500 V. The applying of the bias by the main charging unit 112Y increases the absolute value of the charging potential of the photosensitive body 20Y and the applying of the bias by the auxiliary charging unit 113Y decreases the absolute value of the charging potential of the photosensitive body 20Y.

It is known that the degree of the discharge deterioration of the photosensitive body 20Y is greater in the case where the change in charging potential is large in comparison to the case where the change in charging potential is small. It is known that the degree of the discharge deterioration of the photosensitive body 20Y is lower in charging of a neutralizing direction than in charging of an electricity supply direction. As a result, the degree of discharge deterioration is higher in the charging portion of the photosensitive body 20Y by the main charging unit 112Y than in the charging portion of the photosensitive body 20Y by the auxiliary charging unit 113Y.

In the image forming apparatus of Embodiment 2, the protective agent supplying unit 111Y is disposed at the upstream side of the main charging unit 112Y, and a sufficient amount of protective agent is supplied to the charging portion of the main charging unit 112Y with a high degree of discharge deterioration. Meanwhile, since the charging portion of the auxiliary charging unit 113Y has a low degree of discharge deterioration, the protective agent supply amount control unit 115Y for recovering the portion of the protective agent by the electric field between the main charging unit 112Y and the auxiliary charging unit 113Y is disposed. The protective agent deteriorated and charged by the main charging portion with high charging ability can be removed by the protective agent supply amount control unit 115Y, the amount of protective agent supplied to the auxiliary charging portion with low charging ability can be suppressed, and the mixing of the protective agent into the development unit or the transferring of the deteriorated protective agent to the primary transfer unit can be prevented. In addition, since the protective agent is charged to the polarity that is opposite to the polarity of the toner by the auxiliary charging unit 113Y, the mixing of the protective agent into the development unit 50Y and the transferring of the protective agent to the primary transfer unit are further suppressed. By changing the bias applied to the protective agent supply amount control unit 115Y, it is possible to increase or decrease the amount of protective agent removed by the protective agent supply amount control unit.

In the image forming apparatus of Embodiment 2, by using the conductive brush roller as the main charging unit 112Y, the protective agent of the surface of the photosensitive body 20Y can be charged from a flier. Thus, it is difficult to form a fixed layer of the protective agent on the photosensitive body 20Y and to improve the recovery property of the protective agent supply amount control unit 115Y.

In the image forming apparatus of Embodiment 2, since the auxiliary charging unit 113Y is the scorotron charger, applies the bias having the same polarity as the regular charging polarity of the toner to a grid, and applies the bias having the polarity opposite to the regular charging polarity of the toner to a wire, it is possible to spread corona with the polarity that is opposite to the regular charging polarity of the toner while maintaining the charging potential of the photosensitive body 20Y at the same polarity as the regular charging polarity of the toner, and to charge the protective agent to the polarity opposite to the regular charging polarity of the toner. Since the charging potential of the photosensitive body 20Y attains an equilibrium state at a grid voltage, it is possible to uniformize the charging potential of the photosensitive body 20Y which becomes nonuniform due to the applying of the protective agent. The second charging unit can perform neutralizing by a potential for eliminating the nonuniformity of the charging generated due to the first charging unit and suppress the generation of ozone or the generation of the discharge products in the auxiliary charging unit, and the deterioration of the photosensitive layer to the minimum.

In the image forming apparatus of Embodiment 2, since the development unit is not in contact with the photosensitive body 20Y, it is possible to prevent the mixing of the physical protective agent due to the contact of the development member. Even when the charging of the protective agent is weak, it is easy to prevent or suppress the mixing into the development unit.

Figure 4:
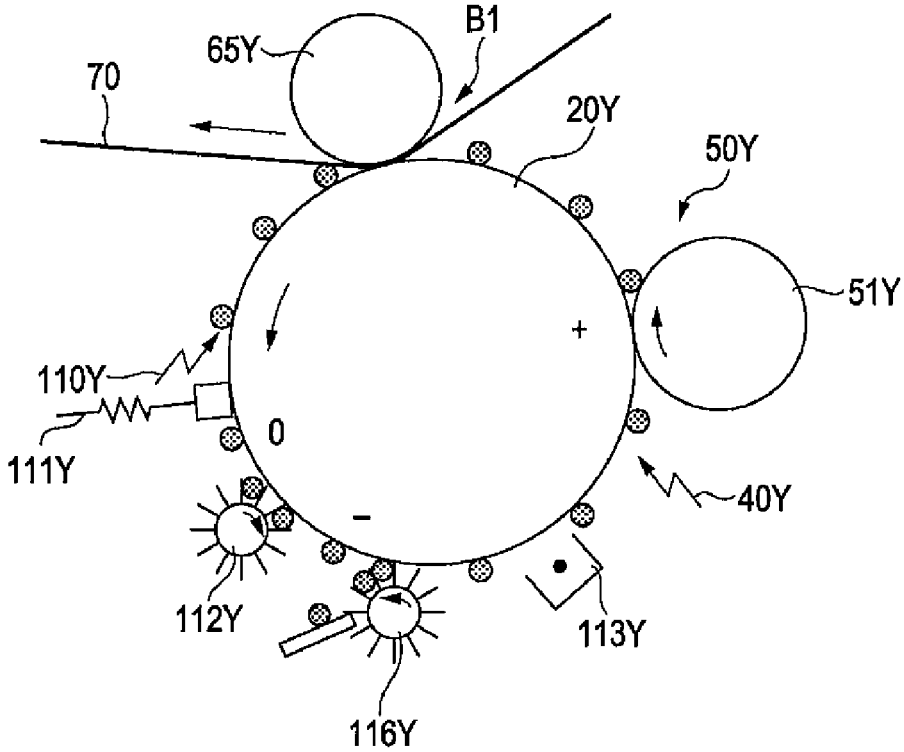
FIG. 4 is a view showing the embodiment of the invention.

FIG. 4 shows an image forming apparatus according to Embodiment 3 for solving the problems of the known apparatus, in the image forming apparatus for applying the protective agent on the photosensitive body. Although the image forming apparatus of Embodiment 3 may be applied to a single-color image forming apparatus, FIG. 4 shows, for example, a yellow image forming unit 15Y of a color image forming apparatus.

In the image forming apparatus of Embodiment 3, the neutralizing unit 110Y, the protective agent supplying unit 111Y, the main charging unit 112Y, the protective agent supply amount control and cleaning unit 116Y, the auxiliary charging unit 113Y, the exposure unit 40Y, the development unit 50Y, and the primary transfer unit are disposed at the downstream side of the primary transfer unit B1 in this order.

In the image forming apparatus of Embodiment 3, unlike the image forming apparatuses of Embodiments 1 and 2, the photosensitive body cleaning blade 76Y is not disposed at the downstream side of the neutralizing unit 110Y. In addition, the protective agent supplying unit 111Y brings a zinc stearate block into direct contact with the photosensitive body 20Y and applies the protective agent on the photosensitive body 20Y. The other configuration of the image forming apparatus of Embodiment 3 is equal to that of the image forming apparatuses of Embodiments 1 and 2 and thus the description thereof will be omitted.

The main charging unit 112Y of Embodiment 3 applies a bias of −1500 V exceeding 600 V which is a discharge limit of the photosensitive body used in the present embodiment, and charges the surface of the photosensitive body 20Y, the protective agent applied by the protective agent supplying unit 111Y and the residue on the photosensitive body 20Y after transfer to the same polarity as the regular charging polarity of the toner. The charging potential of the photosensitive body 20Y after applying the bias by the main charging unit 112Y is −900 V.

The scorotron charger which is the auxiliary charging unit 113Y applies a bias of −500 V, which has the same polarity as the regular charging polarity of the toner, to a grid, flows current of +200 μA, which has the polarity that is opposite to the regular charging polarity of the toner, to a wire, spreads corona having the opposite polarity to the regular charging polarity of the toner on the surface of the photosensitive body, and charges the protective agent to the polarity opposite to the regular charging polarity of the toner. The potential of the photosensitive body 20Y after passing through the auxiliary charging unit 113Y becomes −500 V.

The charging potential of the photosensitive body 20Y is changed from 0 V to −900 V by applying the bias by the main charging unit 112Y, and a change in charging potential is 900 V. Meanwhile, the charging potential of the photosensitive body 20Y is changed from −900 V to −500 V by applying the bias by the auxiliary charging unit 113Y, and a charging variation is 400 V. The applying of the bias by the main charging unit 112Y increases the absolute value of the charging potential of the photosensitive body 20Y and the applying of the bias by the auxiliary charging unit 113Y decreases the absolute value of the charging potential of the photosensitive body 20Y.

It is known that the degree of the discharge deterioration of the photosensitive body 20Y is higher when the change in charging potential is large than when the change in charging potential is small. It is known that the degree of discharge deterioration of the photosensitive body 20Y is lower in charging of a neutralizing direction than in charging of an electricity supply direction. As a result, the degree of discharge deterioration is higher in the charging portion of the photosensitive body 20Y by the main charging unit 112Y than in the charging portion of the photosensitive body 20Y by the auxiliary charging unit 113Y.

In the image forming apparatus of Embodiment 3, the protective agent supplying unit 111Y is disposed at the upstream side of the main charging unit 112Y, and a sufficient amount of protective agent is supplied to the charging portion of the main charging unit 112Y with a high degree of discharge deterioration. Meanwhile, since the charging portion of the auxiliary charging unit 113Y has a low degree of discharge deterioration, the protective agent supply amount control and cleaning unit 116Y for recovering the protective agent by the electric field between the main charging unit 112Y and the auxiliary charging unit 113Y is disposed and the surplus protective agent is prevented from going to the charging portion of the auxiliary charging unit 113Y. In the present embodiment, the protective agent supply amount control and cleaning unit 116Y also functions as the cleaning unit for recovering the transfer residue on the photosensitive body 20Y. The protective agent supply amount control and cleaning unit 116Y applies a bias of −700 V to the conductive brush roller and recovers the portion of the protective agent deteriorated by passing through the main charging unit 112Y and the transfer residue on the photosensitive body 20Y by the force of the electric field generated by the potential difference of 200 V with the photosensitive body charged by the main charging unit. Flicker made of a conductive metal plate is brought into contact with the conductive brush roller and the recovered deteriorated protective agent and transfer residue is removed. Since the protective agent passing through the protective agent supply amount control and cleaning unit 116Y is charged to the polarity opposite to the polarity of the toner by the auxiliary charging unit 113Y, it is possible to suppress the mixing of the protective agent into the development unit 50Y and the transferring of the protective agent to the primary transfer unit.

The operation of the image forming process of Embodiment 3 is shown in Table 3.

TABLE 3

| Process | Applied bias | Potential of photosensitive body | Polarity of protective agent | Amount of protective agent |
|---|---|---|---|---|
| Protective agent supplying unit | | 0 V | +<br>0 | Small<br>Large |
| Main charging unit | Vbr1: −1500 V | −900 V | − | |
| Protective agent supply amount control and cleaning unit | Vbr2: −700 V | | | Small |
| Auxiliary charging unit | Vg: −500 V<br>Iw: +200 μA | −500 V | + | |
| Exposure | | −100 V (exposure unit)/−500 V (non-exposure unit) | | |
| Development | Vdc: −150 V<br>Vpp: 1300 V | | | |
| Primary transfer | Vt1: +400 V | | | |
| Neutralizing | | 0 V | | |

Figure 5:
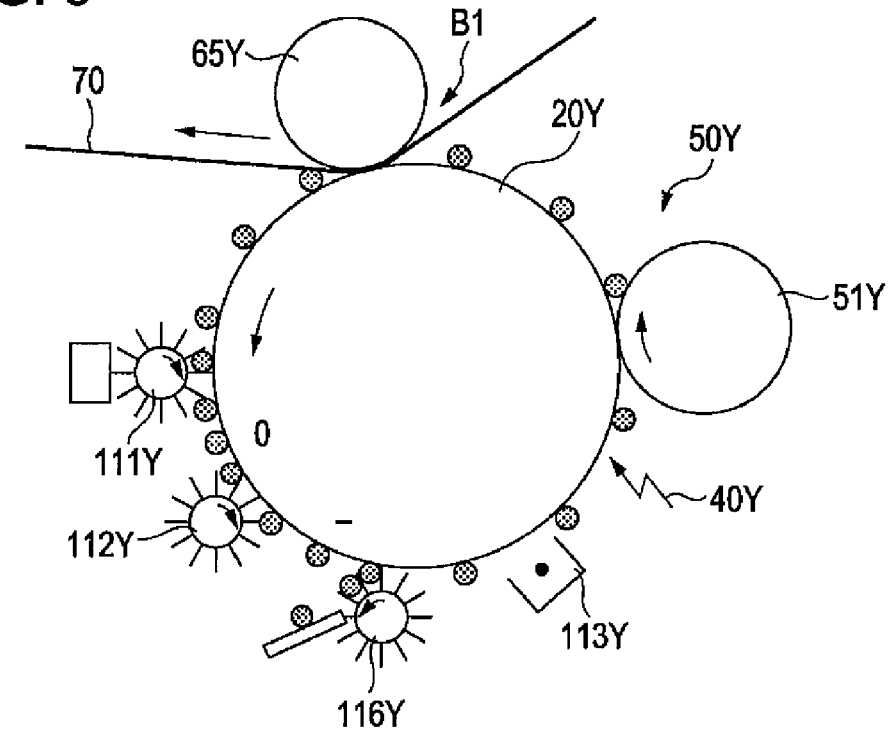
FIG. 5 is a view showing the embodiment of the invention.

FIG. 5 shows an image forming apparatus according to Embodiment 4 for solving the problems of the known apparatus, in the image forming apparatus for applying the protective agent on the photosensitive body. Although the image forming apparatus of Embodiment 4 may be applied to a single-color image forming apparatus, FIG. 5 shows, for example, a yellow image forming unit 15Y of a color image forming apparatus.

In the image forming apparatus of Embodiment 4, the protective agent supplying unit 111Y, the main charging unit 112Y, the protective agent supply amount control and cleaning unit 116Y, the auxiliary charging unit 113Y, the exposure unit 40Y, the development unit 50Y, and the primary transfer unit are disposed at the downstream side of the primary transfer unit B1 in this order.

In the image forming apparatus of Embodiment 4, the neutralizing unit 110Y and the photosensitive body cleaning blade 76Y are not disposed after primary transfer. The protective agent supplying unit 111Y is a conductive brush roller for bringing a zinc stearate block into contact with the photosensitive body and applies the protective agent on the photosensitive body. A bias having the polarity opposite to the regular charging polarity of the toner is applied to the conductive brush roller.

The main charging unit 112Y of Embodiment 4 applies a bias of −1500 V exceeding 600 V which is a discharge limit of the photosensitive body used in the present embodiment, and charges the surface of the photosensitive body 20Y, the protective agent applied by the protective agent supplying unit 111Y and the residue on the photosensitive body 20Y after transfer to the same polarity as the regular charging polarity of the toner. The charging potential of the photosensitive body 20Y after applying the bias by the main charging unit 112Y is −900 V.

The scorotron charger which is the auxiliary charging unit 113Y applies a bias of −400 V, which has the same polarity as the regular charging polarity of the toner, to a grid, flows current of +200 μA, which has the polarity opposite to the regular charging polarity of the toner, to a wire, spreads corona having the polarity opposite to the regular charging polarity of the toner on the surface of the photosensitive body, and charges the protective agent to the polarity opposite to the regular charging polarity of the toner. The potential of the photosensitive body 20Y after passing through the auxiliary charging unit 113Y becomes −400 V.

Since the neutralizing unit 110Y is not provided, the charging potential of the photosensitive body 20Y by applying the bias by the main charging unit 112Y is changed from −100 V (exposure unit) and −400 V (non-exposure unit) which are the charging potentials of the photosensitive body 20Y after primary transfer to −900 V, and the change in charging potential is 800 V (exposure unit) and 500 V (non-exposure unit). Meanwhile, the charging potential of the photosensitive body 20Y is changed from −900 V to −400 V by applying the bias by the auxiliary charging unit 113Y, and a charging variation is 500 V. The applying of the bias by the main charging unit 112Y increases the absolute value of the charging potential of the photosensitive body 20Y and the applying of the bias by the auxiliary charging unit 113Y decreases the absolute value of the charging potential of the photosensitive body 20Y.

It is known that the degree of discharge deterioration of the photosensitive body 20Y is lower in charging of a neutralizing direction than in charging of the electricity supply direction. As a result, the degree of discharge deterioration is higher in the charging portion of the photosensitive body 20Y by the main charging unit 112Y than in the charging portion of the photosensitive body 20Y by the auxiliary charging unit 113Y.

In the image forming apparatus of Embodiment 4, the protective agent supplying unit 111Y is disposed at the upstream side of the main charging unit 112Y, and a sufficient amount of protective agent is supplied to the charging portion of the main charging unit 112Y with a high degree of discharge deterioration. Meanwhile, since the charging portion of the auxiliary charging unit 113Y has a low degree of discharge deterioration, the protective agent supply amount control and cleaning unit 116Y for recovering the protective agent by the electric field between the main charging unit 112Y and the auxiliary charging unit 113Y is disposed and the surplus protective agent is prevented from going to the charging portion of the auxiliary charging unit 113Y. The protective agent supply amount control and cleaning unit 116Y applies a bias of −700 V to the conductive brush roller and recovers the protective agent deteriorated by passing through the main charging unit 112Y by the force of the electric field generated by the potential difference of 200 V with the photosensitive body charged by the main charging unit. Flicker made of a conductive metal plate is brought into contact with the conductive brush roller and the recovered deteriorated protective agent is removed. Since the protective agent passing through the protective agent supply amount control and cleaning unit 116Y is charged to the polarity opposite to the polarity of the toner by the auxiliary charging unit 113Y, it is possible to suppress the mixing of the protective agent into the development unit 50Y and the transferring of the protective agent to the primary transfer unit. The protective agent passing through the development unit and the primary transfer unit reaches the protective agent supplying unit 111Y again. A bias of +100 V which has the polarity opposite to the regular charging potential of the toner is applied to the protective agent supplying unit 111Y, and a potential difference of 200 V is provided between the exposure unit of the photosensitive body and the protective agent supplying unit and a potential difference of 500 V is provided between the non-exposure unit of the photosensitive body and the protective agent supplying unit. Since the protective agent reaching the protective agent supplying unit 111Y is charged to the polarity opposite to the regular charging polarity of the toner, the protective agent is not recovered to the protective agent supplying unit 111Y by this potential difference. Thus, it is possible to prevent the protective agent supplying unit 111Y from being contaminated by the deteriorated protective agent and to prevent deterioration of the scraping ability of the protective agent block.

The operation of the image forming process of Embodiment 4 is shown in Table 4.

TABLE 4

| Process | Applied bias | Potential of photosensitive body | Polarity of protective agent | Amount of protective agent |
|---|---|---|---|---|
| Protective agent supplying unit | Vbr3: +100 V | −100 V (exposure unit)/−400 V (non-exposure unit) | +<br>0 | Small<br>Large |
| Main charging unit | Vbr1: −1500 V | −900 V | − | |
| Cleaning unit | Vbr2: −700 V | | | Small |
| Auxiliary charging unit | Vg: −400 V<br>Iw: +200 μA | −400 V | + | |
| Exposure | | −100 V (exposure unit)/−400 V (non-exposure unit) | | |
| Development | Vdc: −150 V<br>Vpp: 1300 V | | | |
| Primary transfer | Vt1: +400 V | | | |

Figure 6:
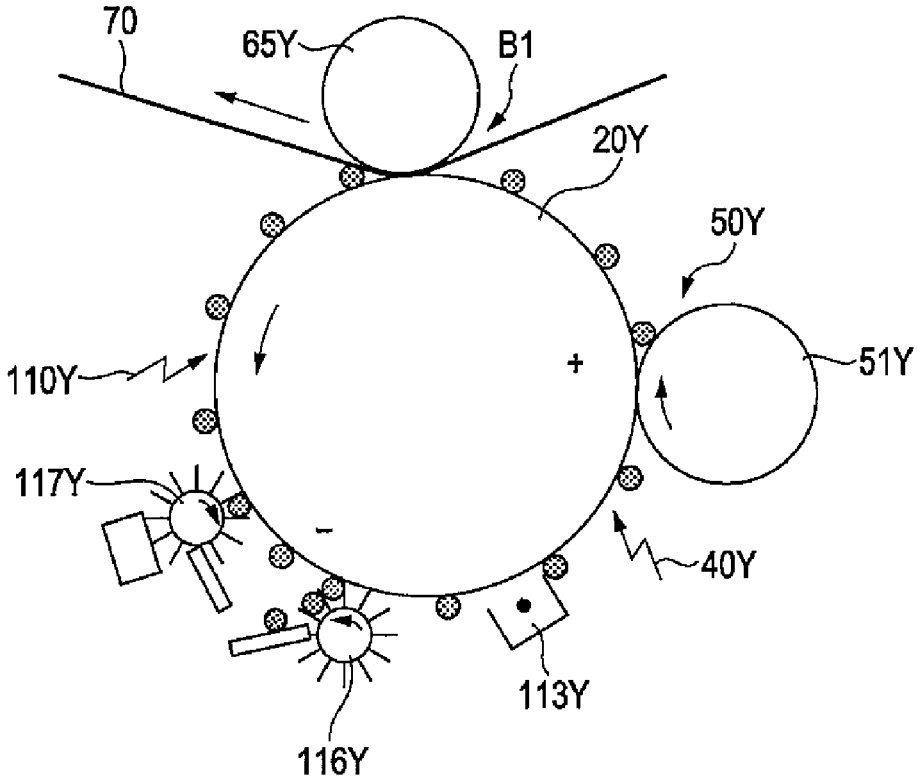
FIG. 6 is a view showing the embodiment of the invention.

FIG. 6 shows an image forming apparatus according to Embodiment 5 for solving the problems of the known apparatus, in the image forming apparatus for applying the protective agent on the photosensitive body. Although the image forming apparatus of Embodiment 5 may be applied to a single-color image forming apparatus, FIG. 6 shows, for example, a yellow image forming unit 15Y of a color image forming apparatus.

In the image forming apparatus of Embodiment 5, the neutralizing unit 110Y, a conductive brush roller which is a protective agent supplying and main charging unit 117Y also functioning as the protective agent supplying unit and the main charging unit using one member, the protective agent supply amount control and cleaning unit 116Y, the auxiliary charging unit 113Y, the exposure unit 40Y, the development unit 50Y, and the primary transfer unit are disposed at the downstream side of the primary transfer unit B1 in this order.

The conductive brush roller which is the protective supplying and main charging unit 117Y of Embodiment 5 rotates in the clockwise direction which is the opposite direction to the rotation direction of the photosensitive body 20Y. Flicker which is made of a conductive metal plate to remove the protective agent attached to the conductive brush after main charging is brought into contact with the upstream side of the rotation direction of the conductive brush roller which is the protective agent supplying and main charging unit 117Y and a zinc stearate block is brought into contact with the downstream side thereof such that the protective agent is supplied to the conductive brush roller, the protective agent is applied on the photosensitive body 20Y, and the photosensitive body 20Y is charged as the main charging unit. Since the charging the photosensitive body 20Y and the supply of the protective agent can be simultaneously performed, space can be saved. Since one conductive brush roller functions as the protective agent supplying unit and the main charging unit, the contacting process of the photosensitive body 20Y is reduced and it is advantageous with respect to the abrasion of the photosensitive body 20Y. By the discharge between the protective agent supplying and main charging unit 117Y and the photosensitive body 20Y, the protective agent can be applied while being charged to the same polarity as the regular polarity of the toner. In addition, since the protective agent can be charged in a state of being attached to the surface of the main charging unit, abnormal local discharge at a minute gap between the conductive brush roller and the surface of the photosensitive body 20Y can be suppressed and thus the charging potential does not become nonuniform. Accordingly, since the uniformization of the auxiliary charging unit 113Y is facilitated and the change in charging potential of the auxiliary charging unit 113Y can be decreased, it is possible to further suppress discharge deterioration. In addition, it is possible to suppress the amount of ozone generated in the auxiliary charging unit.

The main charging unit 117Y of Embodiment 5 applies a bias of −1500 V exceeding 600 V which is a discharge limit of the photosensitive body used in the present embodiment, and charges the surface of the photosensitive body 20Y, the protective agent applied by the protective agent supplying and main charging unit 117Y and the residue on the photosensitive body 20Y after transfer to the same polarity as the regular charging polarity of the toner. The charging potential of the photosensitive body 20Y after applying the bias by the protective agent supplying and main charging unit 117Y is −900 V.

The scorotron charger which is the auxiliary charging unit 113Y applies a bias of −500 V, which has the same polarity as the regular charging polarity of the toner, to a grid, flows current of +200 μA, which has the polarity opposite to the regular charging polarity of the toner, to a wire, spreads corona having the polarity opposite to the regular charging polarity of the toner on the surface of the photosensitive body, and charges the protective agent to the polarity opposite to the regular charging polarity of the toner. The potential of the photosensitive body 20Y after passing through the auxiliary charging unit 113Y becomes −500 V.

The charging potential of the photosensitive body 20Y is changed from 0 V to −900 V by applying the bias by the protective agent supplying and main charging unit 117Y, and a change in charging potential is 900 V. Meanwhile, the charging potential of the photosensitive body 20Y is changed from −900 V to −500 V by applying the bias by the auxiliary charging unit 113Y, and a charging variation is 400 V. The applying of the bias by the main charging unit 112Y increases the absolute value of the charging potential of the photosensitive body 20Y and the applying of the bias by the auxiliary charging unit 113Y decreases the absolute value of the charging potential of the photosensitive body 20Y.

It is known that the degree of the discharge deterioration of the photosensitive body 20Y is higher when the change in charging potential is small than when the change in charging potential is large. It is known that the degree of discharge deterioration of the photosensitive body 20Y is lower in charging of a neutralizing direction than in charging of an electricity supply direction. As a result, the degree of discharge deterioration is higher in the charging portion of the photosensitive body 20Y by the main charging unit 112Y than in the charging portion of the photosensitive body 20Y by the auxiliary charging unit 113Y.

In the image forming apparatus of Embodiment 5, the protective agent supply amount control and cleaning unit 116Y is disposed between the protective agent supplying and main charging unit 117Y and the auxiliary charging unit 113Y such that the surplus protective agent is prevented from going to the charging portion of the auxiliary charging unit 113Y. The protective agent supply amount control and cleaning unit 116Y also functions as the cleaning member for recovering the residue on the image carrier, applies a bias of −700 V to the conductive brush roller and recovers the portion of the protective agent charged to the same polarity as a regular charging polarity of a toner by being discharged by the protective agent supplying and main charging unit 117Y and the residue on the photosensitive body 20Y after transfer which is charged to the same polarity as the regular charging polarity of the toner by being discharged by the protective agent supplying and main charging unit 117Y by the force of the electric field generated by the potential difference of 200 V with the photosensitive body surface charged by the protective agent supplying and main charging unit 117Y. Flicker made of a conductive metal plate is brought into contact with the conductive brush roller and the recovered deteriorated protective agent is removed. Since the protective agent passing through the protective agent supply amount control and cleaning unit 116Y is charged to the polarity opposite to the polarity of the toner by the auxiliary charging unit 113Y, it is possible to suppress the mixing of the protective agent into the development unit 50Y and the transferring of the protective agent to the primary transfer unit.

The operation of the image forming process of Embodiment 5 is shown in Table 5.

TABLE 5

| Process | Applied bias | Potential of photosensitive body | Polarity of protective agent | Amount of protective agent |
|---|---|---|---|---|
| Protective agent supplying and charging unit | Vbr1: −1500 V | 0 V<br>−900 V | +<br>− | small<br>Large |
| Cleaning unit | Vbr2: −700 V | | | Small |
| Auxiliary charging unit | Vg: −5400 V<br>Iw: +200 μA | −500 V | + | |
| Exposure | | −100 V (exposure unit)/−500 V (non-exposure unit) | | |
| Development | Vdc: −150 V<br>Vpp: 1300 V | | | |
| Primary transfer | Vt1: +400 V | | | |
| Neutralizing | | 0 V | | |

Figure 7:
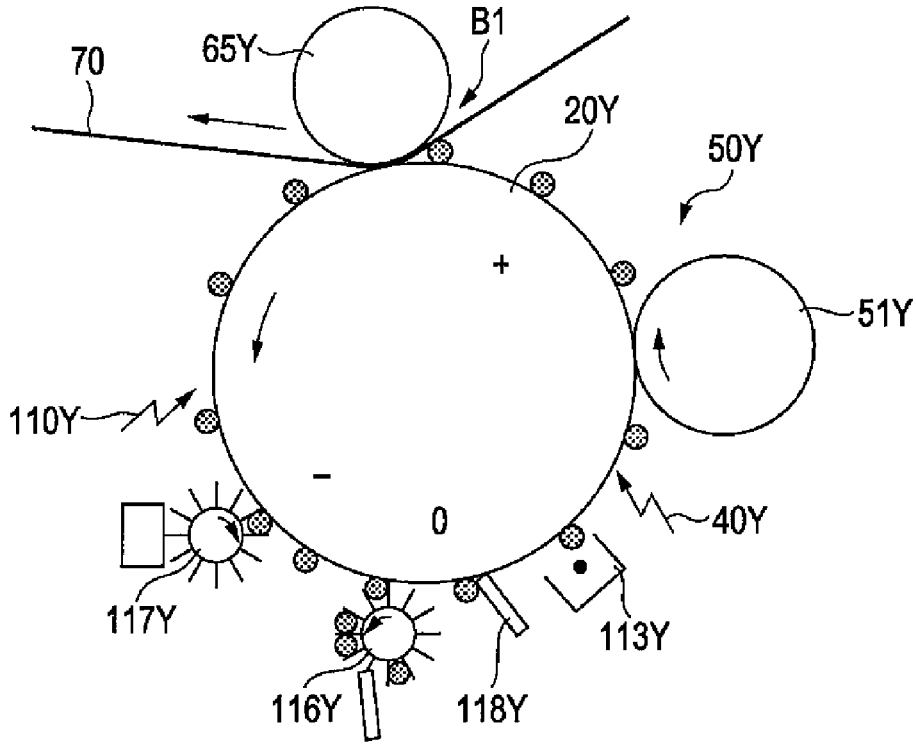
FIG. 7 is a view showing the embodiment of the invention.

FIG. 7 shows an image forming apparatus according to Embodiment 6 for solving the problems of the known apparatus, in the image forming apparatus for applying the protective agent on the photosensitive body. Although the image forming apparatus of Embodiment 6 may be applied to a single-color image forming apparatus, FIG. 7 shows, for example, a yellow image forming unit 15Y of a color image forming apparatus.

In the image forming apparatus of Embodiment 6, the neutralizing unit 110Y, the conductive brush roller which is the protective agent supplying and main charging unit 117Y, the conductive brush roller which is the protective agent supply amount control and cleaning unit 116Y, a uniformizing unit 118Y, the auxiliary charging unit 113Y, the exposure unit 40Y, the development unit 50Y, and the primary transfer unit are disposed at the downstream side of the primary transfer unit B1 in this order.

In the image forming apparatus of Embodiment 6, the uniformizing unit 118Y for uniformizing the supplied protective agent is in contact with the photosensitive body 20Y between the protective agent supply amount control and cleaning unit 116Y and the auxiliary charging unit 113Y. The uniformizing unit 118Y is a rubber blade and has contact pressure of 10 gf/cm with the photosensitive body 20Y. Since the uniformizing unit 118Y does not require the cleaning property of the toner or the protective agent, a freedom degree for setting a contact angle, a contact direction and the contact load is high, the adhesion of the protective agent onto the photosensitive body 20Y can be suppressed, the protective agent becomes uniform, and local deterioration of the surface layer of the photosensitive body 20Y can be reduced.

The protective agent supplying and main charging unit 117Y of Embodiment 6 applies a bias of −1500 V exceeding 600 V which is a discharge limit of the photosensitive body used in the present embodiment, and charges the surface of the photosensitive body 20Y, the protective agent applied by the protective agent supplying and main charging unit 117Y and the residue on the photosensitive body 20Y after transfer. The charging potential of the photosensitive body 20Y after applying the bias by the protective agent supplying and main charging unit 117Y is −900 V.

The scorotron charger which is the auxiliary charging unit 113Y applies a bias of −500 V, which has the same polarity as the regular charging polarity of the toner, to a grid, flows current of +200 μA, which has the polarity opposite to the regular charging polarity of the toner, to a wire, spreads corona having the polarity opposite to the regular charging polarity of the toner on the surface of the photosensitive body, and charges the protective agent to the polarity opposite to the regular charging polarity of the toner. The potential of the photosensitive body 20Y after passing through the auxiliary charging unit 113Y becomes −500 V.

The charging potential of the photosensitive body 20Y is changed from 0 V to −900 V by applying the bias by the protective agent supplying and main charging unit 117Y, and a change in charging potential is 900 V. Meanwhile, the charging potential of the photosensitive body 20Y is changed from −900 V to −500 V by applying the bias by the auxiliary charging unit 113Y, and a charging variation is 400 V. The applying of the bias by the main charging unit 112Y increases the absolute value of the charging potential of the photosensitive body 20Y and the applying of the bias by the auxiliary charging unit 113Y decreases the absolute value of the charging potential of the photosensitive body 20Y.

It is known that the degree of discharge deterioration of the photosensitive body 20Y is higher when the change in charging potential is small than when the change in charging potential is large. It is known that the degree of discharge deterioration of the photosensitive body 20Y is lower in charging of a neutralizing direction than in charging of an electricity supply direction. As a result, the degree of discharge deterioration is higher in the charging portion of the photosensitive body 50Y by the main charging unit 112Y than in the charging portion of the photosensitive body 20Y by the auxiliary charging unit 113Y.

In the image forming apparatus of Embodiment 6, the protective agent supply amount control and cleaning unit 116Y for removing the protective agent by the force of the electric field is disposed between the protective agent supplying and main charging unit 117Y and the auxiliary charging unit 113Y such that the surplus protective agent is prevented from going to the charging portion of the auxiliary charging unit 113Y. The protective agent supply amount control and cleaning unit 116Y also functions as the cleaning member for recovering the residue on the image carrier, applies a bias of −700 V to the conductive brush roller and recovers the portion of the protective agent charged to the same polarity as a regular charging polarity of a toner by being discharged by the protective agent supplying and main charging unit 117Y and the residue on the photosensitive body 20Y after transfer which is charged to the same polarity as the regular charging polarity of the toner by being discharged by the protective agent supplying and main charging unit 117Y by the force of the electric field generated by the potential difference of 200 V with the photosensitive body surface charged by the protective agent supplying and main charging unit 117Y. Flicker made of a conductive metal plate is brought into contact with the conductive brush roller and the recovered deteriorated protective agent is removed. The protective agent passing through the protective agent supply amount control and cleaning unit 116Y is uniformized on the image carrier 20Y by the uniformizing member 118Y and then charged to the polarity opposite to the auxiliary charging unit 113Y. Accordingly, the recovery of the development unit 50Y and the primary transfer unit is suppressed. The protective agent passing through the development unit 50Y and the primary transfer unit reaches the protective agent supplying and main charging unit 117Y so as to prevent discharge deterioration of the image carrier 20Y together with the protective agent newly applied on the photosensitive body 20Y. Since the protective agent newly applied on the photosensitive body 20Y has a powder shape but the protective agent passing through the uniformizing member 118Y, the development unit 50Y and the primary transfer unit 65Y has a uniform film shape on the photosensitive body 20Y, it is possible to more efficiently prevent the discharge deterioration of the photosensitive body 20Y even in a small amount of protective agent newly supplied to the protective agent supplying and main charging unit 117Y.

The operation of the image forming process of Embodiment 6 is shown in Table 6.

TABLE 6

| Process | Applied bias | Potential of photosensitive body | Polarity of protective agent | Amount of protective agent |
|---|---|---|---|---|
| Protective agent supplying and main charging unit | Vbr1: −1500 V | 0 V<br>−900 V | +<br>− | Small<br>Large |
| Cleaning unit<br>Uniformizing unit | Vbr2: −700 V | | | Small |
| Auxiliary charging unit | Vg: −5400 V<br>Iw: +200 μA | −500 V | + | |
| Exposure | | −100 V (exposure unit)/−500 V (non-exposure unit) | | |
| Development | Vdc: −150 V<br>Vpp: 1300 V | | | |
| Primary transfer | Vt1: +400 V | | | |
| Neutralizing | | 0 V | | |

As described above, according to the invention, since the protective agent deteriorated and charged by the main charging unit having high charging ability can be removed by the protective agent supply amount control unit and the amount of protective agent supplied to the auxiliary charging unit having low charging ability can be suppressed, it is possible to suppress sneaking and transferring of the large amount of protective agent deteriorated in the development unit and the transfer unit to the development roller and the transfer member. Since the charges emitted from the auxiliary charging unit is set to (+) such that the protective agent deteriorated by the auxiliary charging unit 113Y can be charged to (+), it is possible to prevent the transfer to the development and the transfer with certainty, to prevent the mixing of the protective agent into the development unit, and to prevent filming of the development roller. In addition, since the transferring of the protective agent to the intermediate transfer belt 70 or the transfer roller can be prevented, it is possible to prevent deterioration of the transfer property, transfer nonuniformity, and filming on the transfer belt. In addition, since the protective agent can be sufficiently supplied to the main charging unit, it is possible to protect the photosensitive body 20Y with certainty.

The entire disclosure of Japanese Patent Application No. 2008-191794, filed Jul. 25, 2008 is expressly incorporated by reference herein.

What is claimed is:

1. An image forming method comprising:

supplying a protective agent to an image carrier; and charging the image carrier by a plurality of charging units, wherein degrees of discharge deterioration of the surface of the image carrier in the plurality of charging units are different, and wherein, in the amounts of protective agent supplied to charging portions of the plurality of charging units, the amount of protective agent supplied to a charging portion, in which a degree of discharge deterioration of the surface of the image carrier is high, is large.

2. The image forming method according to claim 1, wherein, in the charging of the image carrier by the plurality of charging units, changes in charging potential of the image carrier in the charging portions are different, and the amount of protective agent supplied to the charging portion in which the change in charging potential of the image carrier is large is larger than the amount of protective agent supplied to the charging portion in which the change in charging potential of the image carrier is small.

3. The image forming method according to claim 1, wherein:

the charging of the image carrier by the plurality of charging units includes:

a charging process of increasing an absolute value of the charging potential of the image carrier, and a charging process of decreasing the absolute value of the charging potential of the image carrier, the amount of protective agent supplied to the charging process of increasing the absolute value of the charging potential of the image carrier is larger than the amount of protective agent supplied to the charging process of decreasing the absolute value of the charging potential of the image carrier.

4. The image forming method according to claim 1, wherein, in the charging of the image carrier by the plurality of charging units, a change in charging potential to the image carrier in the charging portion of a first charging process is larger than a change in charging potential to the image carrier in the charging portion of a subsequent charging process, the charging portion of a final charging process decreases the absolute value of the charging potential of the image carrier, the supplying of the protective agent is provided before the first charging process, and controlling of an amount of protective agent supplied to the image carrier is provided between the charging processes by the plurality of charging units.

5. The image forming method according to claim 1, wherein:

the plurality of charging units includes a main charging unit and an auxiliary charging unit, the main charging unit is located at an upstream side of the auxiliary charging unit in a movement direction of the image carrier, the degree of discharge deterioration of the surface of the image carrier in the charging process by the main charging unit is higher than the degree of discharge deterioration of the surface of the image carrier in the charging process by the auxiliary charging unit, and the amount of protective agent supplied to the charging portion of the main charging unit is larger than the amount of protective agent supplied to the charging portion of the auxiliary charging unit.

6. The image forming method according to claim 5, wherein:

the supplying of the protective agent to the image carrier is provided before the charging process by the main charging unit, and controlling of an amount of protective agent supplied to the auxiliary charging unit is provided between the charging process by the main charging unit and the charging process by the auxiliary charging unit.

7. The image forming method according to claim 6, wherein the controlling of the amount of protective agent includes recovering a portion of the protective agent deteriorated in the main charging unit by force of an electric field.

8. The image forming method according to claim 5, wherein:

the charging process by the main charging unit charges the surface of the image carrier and a residue on the image carrier to the same polarity as a regular charging polarity of a toner, controlling of an amount of protective agent includes a cleaning process of recovering the residue on the image carrier after transfer by force of an electric field, and the charging process by the auxiliary charging unit is a charging process of emitting charges having the polarity opposite to a regular charging polarity of a toner on the image carrier such that the charging potential of the image carrier is smaller than the charging potential charged by the main charging unit in an absolute value thereof.

9. The image forming method according to claim 6, wherein a same protective agent supplying unit is used in the supplying of the protective agent and a main charging unit.

10. The image forming method according to claim 9, wherein the main charging unit is a conductive brush roller functioning as the protective agent supplying unit.

11. The image forming method according to claim 5, wherein the auxiliary charging unit is a scorotron charger, applies a voltage having the same polarity as a regular charging polarity of a toner to a grid, and flows current having the polarity opposite to the regular charging polarity of the toner to a wire.

12. The image forming method according to claim 6, wherein uniformizing of the protective agent on the image carrier is provided between the supplying of the protective agent and the charging process by the auxiliary charging unit.

13. The image forming method according to claim 1, further comprising:

forming an electrostatic latent image on the image carrier;

developing the latent image on the image carrier, wherein the developing is non-contact developing.

14. An image forming apparatus comprising:

a rotatable image carrier;

a protective agent supplying unit supplying a protective agent on the image carrier;

a plurality of charging units charging the image carrier;

an exposure unit forming an electrostatic latent image on the image carrier;

a development unit developing the electrostatic latent image of the image carrier; and a transfer unit transferring the image of the image carrier, wherein degrees of discharge deterioration of the surface of the image carrier in the plurality of charging units are different, and wherein a protective agent supply amount control unit for controlling the amount of the protective agent supplied to a charging portion of a charging unit having a low degree of discharge deterioration to be smaller than the amount of the protective agent supplied to a charging portion having high degree of discharge deterioration.

15. An image forming apparatus comprising:

a rotatable image carrier;

a protective agent supplying unit supplying a protective agent on the image carrier;

a main charging unit charging the image carrier;

an auxiliary charging unit located at the downstream side of the main charging unit in a movement direction of the image carrier and charging the image carrier;

an exposure unit forming an electrostatic latent image on the image carrier;

a development unit developing the electrostatic latent image of the image carrier; and a transfer unit transferring the image of the image carrier, wherein the main charging unit charges the surface of the image carrier and a residue on the image carrier to the same polarity as the regular polarity of a toner, wherein a change in charging potential of the image carrier in the main charging unit is larger than a change in charging potential of the image carrier in the auxiliary charging unit, and the main charging unit charges the image carrier such that the charging potential of the image carrier is large in an absolute value thereof, wherein the auxiliary charging unit charges the image carrier such that the charging potential of the image carrier is small in the absolute value thereof;

wherein the main charging unit is a conductive brush roller functioning as the protective agent supplying unit, wherein a protective agent supply amount control unit is provided between the main charging unit and the auxiliary charging unit, wherein a uniformizing member which uniformize the protective agent is included between the protective agent supply amount control unit and the auxiliary charging unit, wherein the protective agent supply amount control unit is a conductive brush roller also functioning as a cleaning unit which removes the residue on the image carrier by an electric field, and wherein the auxiliary charging unit is a scorotron charger, applies a voltage having the same polarity as a regular charging polarity of a toner to a grid, and flows current having the polarity opposite to the regular charging polarity of the toner to a wire.

* * * * *